US005700230A

United States Patent [19]

Cardona

[11] Patent Number: 5,700,230

[45] Date of Patent: Dec. 23, 1997

[54] MARTIAL ARTS TRAINING DEVICE

[76] Inventor: Alfred M. Cardona, 3 Crugers Rd., Montrose, N.Y. 10548

[21] Appl. No.: 650,878

[22] Filed: May 20, 1996

[51] Int. Cl.[6] ..... A63B 21/00

[52] U.S. Cl. ..... 482/83; 482/87; 482/90

[58] Field of Search ..... 482/83–90; 473/440–441, 473/442, 443, 444, 445

[56] References Cited

U.S. PATENT DOCUMENTS

| | | | |
|---|---|---|---|
| 547,731 | 10/1895 | MacLearn | 482/85 |
| 1,481,594 | 1/1924 | Fitzgerald | 482/85 |
| 2,913,245 | 11/1959 | Landis | 482/90 |
| 4,387,892 | 6/1983 | Wen | 482/83 |
| 4,564,192 | 1/1986 | Lebowitz | 482/87 |
| 5,256,069 | 10/1993 | Snowden, Jr. et al. | 482/83 |
| 5,437,590 | 8/1995 | D'Alto | 482/83 |

*Primary Examiner*—Jerome Donnelly
*Attorney, Agent, or Firm*—Michael I. Kroll

[57] ABSTRACT

A martial arts training device (14) which comprises a movable mannequin (16) having a human appearance. A structure (18) is for supporting the mannequin (16) in a generally upright position from a floor (20). A facility (22) within the mannequin (16), is for showing a reaction movement of a portion of the mannequin (16), when another portion of the mannequin receives a blow thereto from a martial artist (24).

16 Claims, 5 Drawing Sheets

Fig. 2
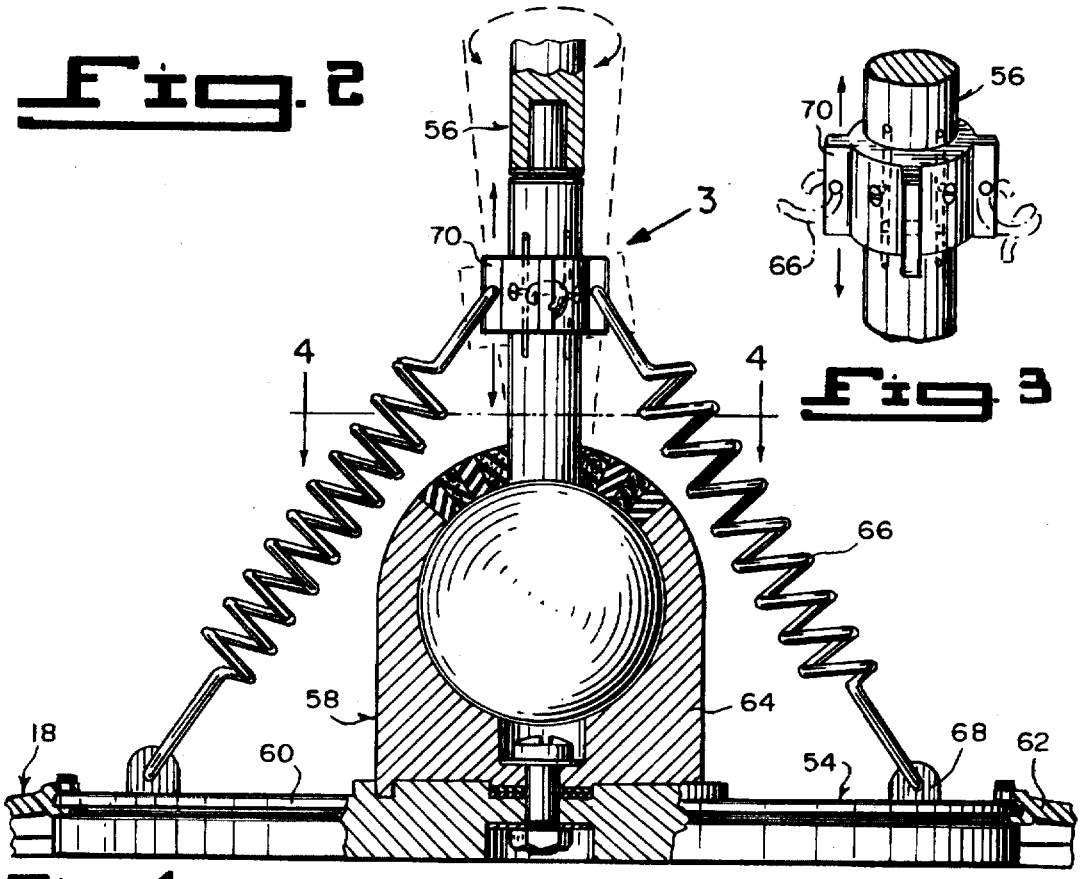
Fig. 3
Fig. 4
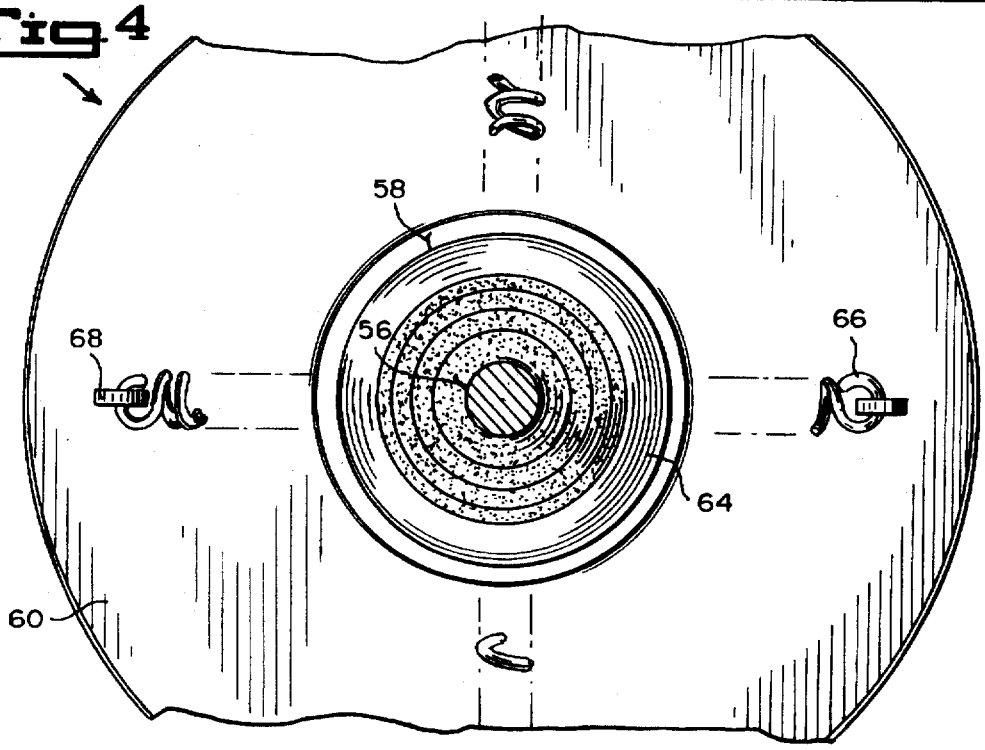

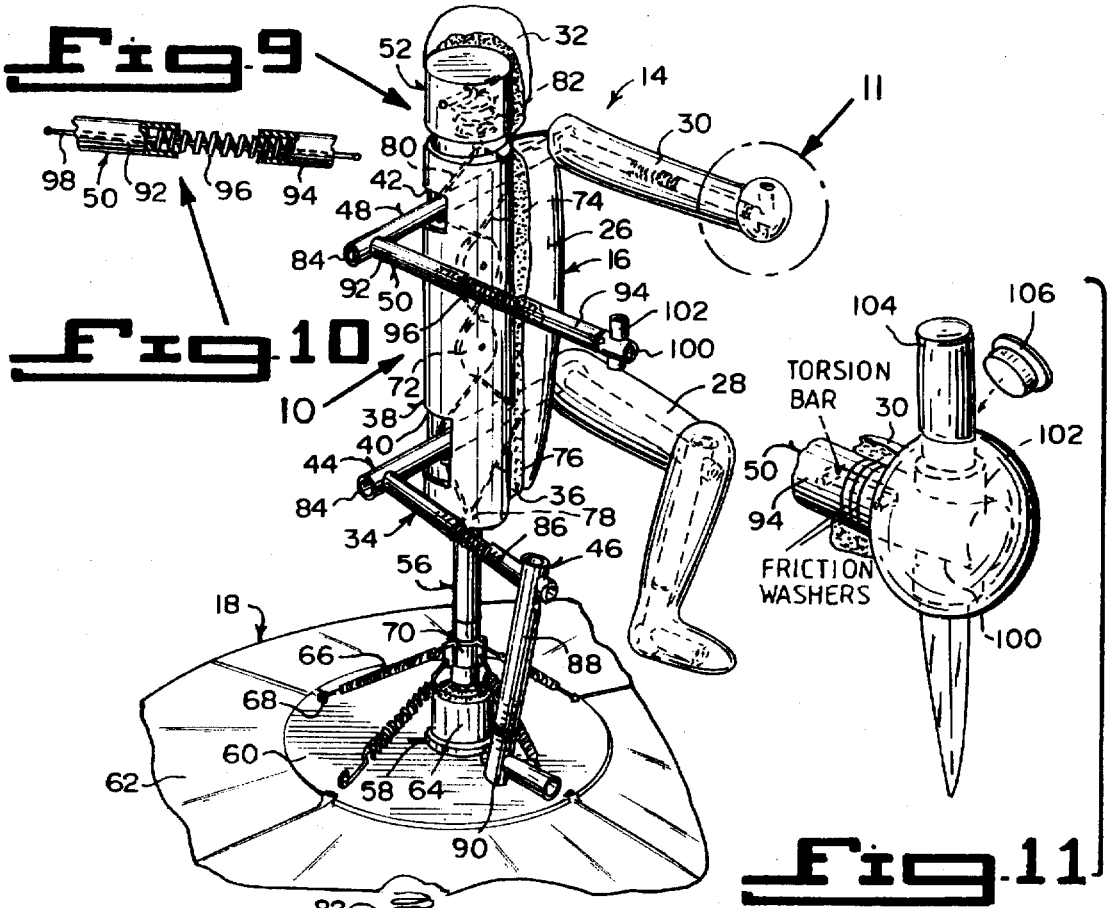
Fig. 9
Fig. 10
Fig. 11
TORSION BAR
FRICTION WASHERS
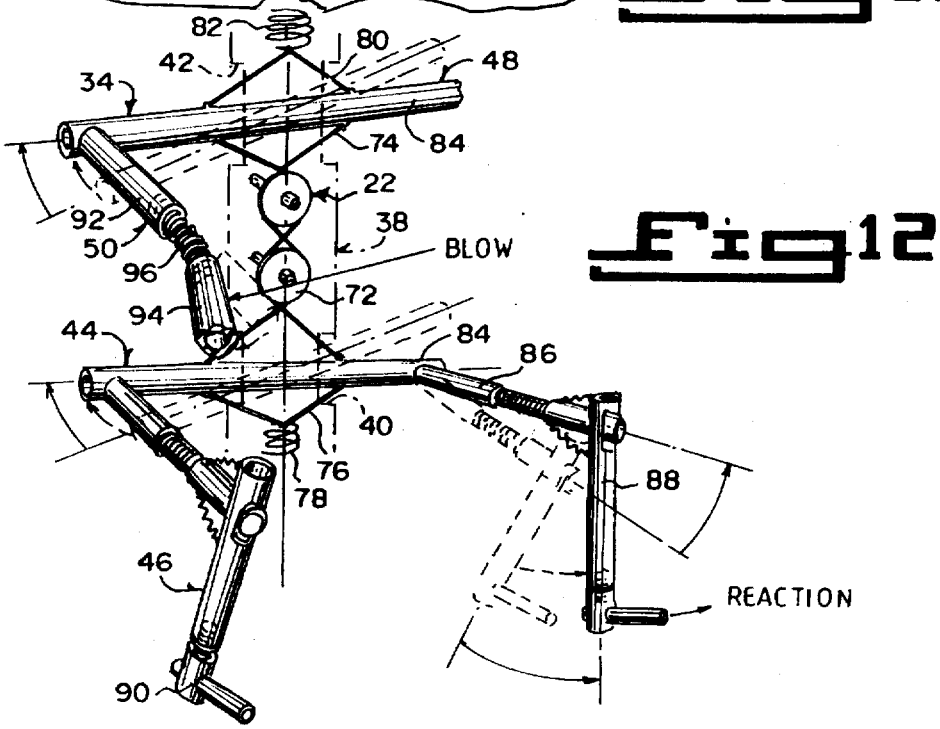
Fig. 12
BLOW
REACTION

MARTIAL ARTS TRAINING DEVICE

BACKGROUND OF THE INVENTION

1. Field of the Invention

The instant invention relates generally to training aids and more specifically it relates to a martial arts training device.

2. Description of the Prior Art

Numerous training aids have been provided in prior art. For example, U.S. Pat. Nos. 2,909,370 to Forthey; 4,088,315 to Schemmel; 4,974,833 to Hartman et al. and 5,256,069 to Snowden, Jr., et. al. all are illustrative of such prior art. While these units may be suitable for the particular purpose to which they address, they would not be as suitable for the purposes of the present invention as heretofore described.

U.S. Pat. No. 2,909,370 (Fortney) discloses a boxing dummy for use in the training of boxers. The dummy has a torso, legs, arms and head built upon a framework to simulate a boxer. The dummy comprises a base adapted to rest upon a floor. A pair of bars each have one end rigidly secured to the base and extend in an upward direction therefrom to constitute the leg frame members of the dummy. The bars continue upwardly from the leg portions of the dummy to constitute a frame member within the torso of the dummy. The bars terminate within the torso at the level of the arm-to-shoulder joints of the dummy. A shaft is positioned across the upper ends of the bars. Bearing means by which the shaft is journaled to the ends of the bars is to turn about its longitudinal axis. An arm frame member is rigidly secured to each end of the shaft. A bar extends upwardly from a point intermediate the ends of the shaft to constitute a head frame member of the dummy. Mounting means is for securing the lower end of the head bar to the shaft by which movement of the head bar in revolution about the shaft turns the shaft in the bearing means about its longitudinal axis.

U.S. Pat. No. 4,088,315 (Schemmel) discloses an improved device for use in self defense training, as in karate and the like, includes a life-like articulated training dummy supported in an upright position on a post and having a plurality of separate pressure receptors disposed at various target locations in the dummy. The receptors are interconnected to a signal such as individual lights in a remote display panel so that hits on the receptors can be separately displayed by the panel. The panel can include a timer, hit sequence counter, hit sequence programmer, printed read out, and hit sequence replayer, as well as a warning signal, visual and/or audible, and other safety and training aids. The receptors can be made to distinguish between light and heavy blows. the support post can be rotated at high speed to cause the dummy to simulate an attack when activated by weight detectors in a base around the post. The weight detectors are also disposable in the base in a mode to facilitate stance training. The dummy and post can be provided with shock absorbing elements to protect them from heavy hits during practice. Preferably the dummy includes a tough, resilient surface layer for further protection of the dummy and trainee (one using the dummy) and for toughening the hands of the trainee. The device provides unique advantages in the art of self defense training.

U.S. Pat. No. 4,974,833 (Hartman et al.) discloses an electronic martial arts training device. The martial arts training device of the present invention includes a pliable substrate of sufficient thickness to absorb a full impact martial arts blow without injuring the deliverer thereof. A pictorial representation of a martial arts combatant is disposed on one surface of the pliable substrate and a plurality of target lights are disposed within the pliable substrate beneath the pictorial representation at locations which correspond to the "vital-points" of the pictured combatant. Mounted within the pliable substrate in conjunction with each target light is a miniature loud speaker having a vibratable cone and a pair of electrical terminals which are coupled to the vibratable cone via a movable coil. Vibrations induced into the vibratable cone by the impact of a martial arts blow will result in an electrical signal being generated at the electrical terminals. A control circuit is then utilized to selectively illuminate the target lights and couple the electrical signal output by each associated miniature loud speaker to a scoring indicator which provides an indication of a student's proficiency.

U.S. Pat. No. 5,256,069 (Snowden, Jr. et al.) discloses a boxing dummy arranged for wall and floor mounting having a torso, with the torso including appendages directed forwardly of the torso, and a head member spring mounted to the torso portion in a coaxially aligned relationship. Each of the appendages includes an impact receiving pad, with the impact receiving pad formed of a plurality of concentric polymeric rings of varying hardness.

SUMMARY OF THE INVENTION

A primary object of the present invention is to provide a martial arts training device that will overcome the shortcomings of the prior art devices.

Another object is to provide a martial arts training device that can be used as a trainer for martial artists in individual homes, school settings, police academies and precincts, boxing clubs and other training areas.

An additional object is to provide a martial arts training device that would develop arms, hand/eye coordination, stick techniques, bone breaking of arms, wrist turning, kicking techniques and hand/foot speed.

A further object is to provide a martial arts training device that is simple and easy to use.

A still further object is to provide a martial arts training device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2 is an enlarged elevational view taken in the direction of arrow 2 in FIG. 1 with parts broken away and in section.

FIG. 3 is a perspective view taken in the direction of arrow 3 in FIG. 2 of a portion thereof, showing the spring tension adjustment member in greater detail.

FIG. 4 is a cross sectional view taken along line 4—4 in FIG. 2 with parts broken away.

FIG. 9 is a perspective view of the instant invention with parts of the mannequin broken away to see the skeletal framework in greater detail.

FIG. 10 is an elevational view taken in the direction of arrow 10 in FIG. 9, with parts broken away and in section of one skeletal arm member.

FIG. 11 is an enlarged perspective view of the area indicated by arrow 11 in FIG. 10.

FIG. 12 is a perspective view of a portion of the skeletal framework, showing a reaction movement in a leg member when an opposite arm member receives a blow thereto.

Similar reference characters denote corresponding features consistently throughout the attached drawings.

DETAILED DESCRIPTION OF THE PREFERRED EMBODIMENTS

Figure 1:
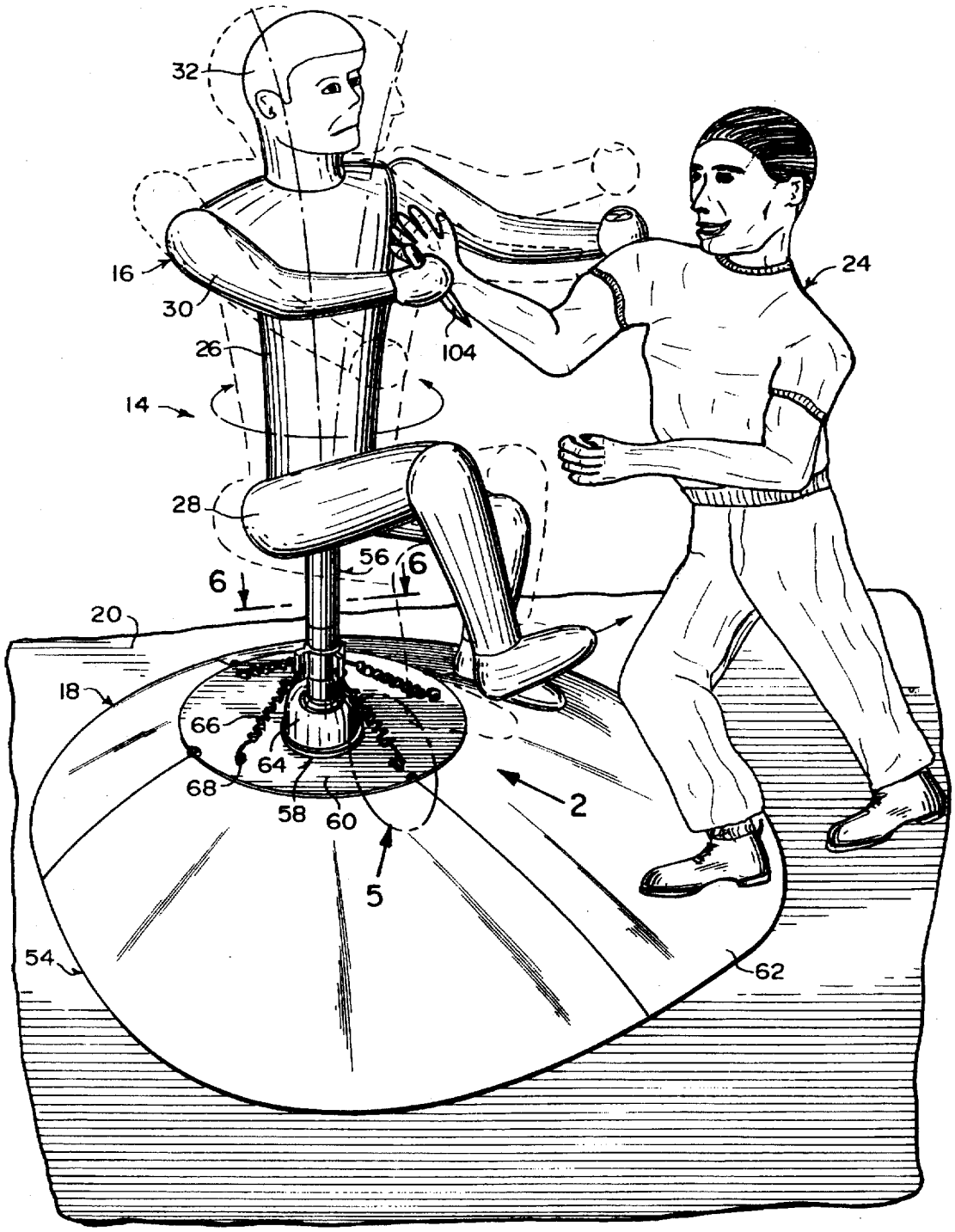
FIG. 1 is a perspective view showing a martial artist using the instant invention.
Figure 5:
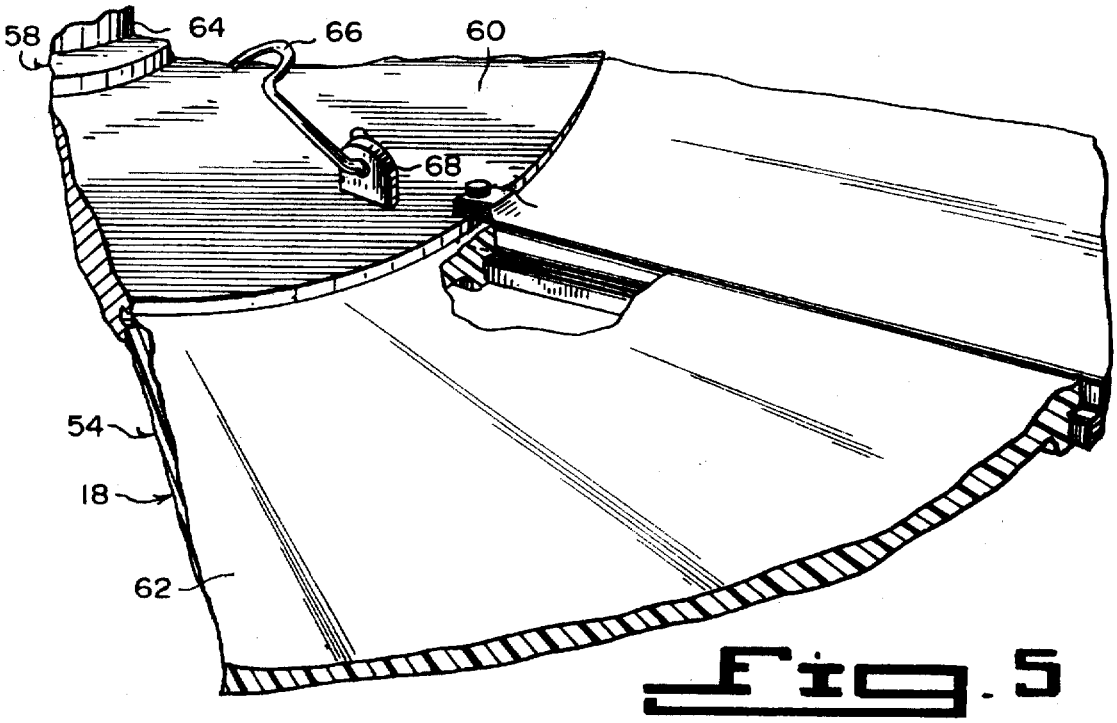
FIG. 5 is an enlarged perspective view of the area indicated by arrow 5 in FIG. 1.
Figure 6:
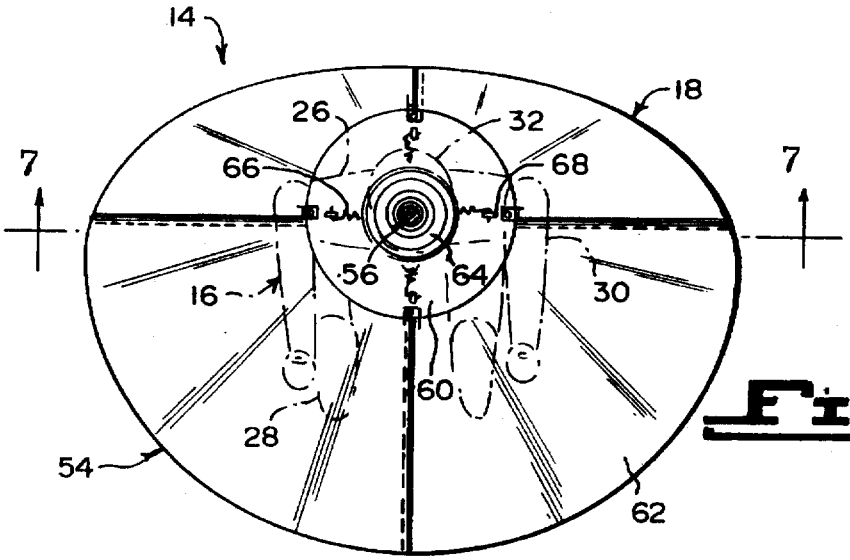
FIG. 6 is a cross sectional view taken along line 6—6 in FIG. 1, showing the mannequin thereon in phantom.
Figure 7:
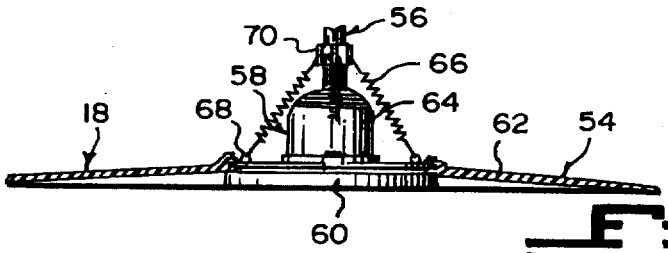
FIG. 7 is a cross sectional view taken along line 7—7 in FIG. 6.
Figure 8:
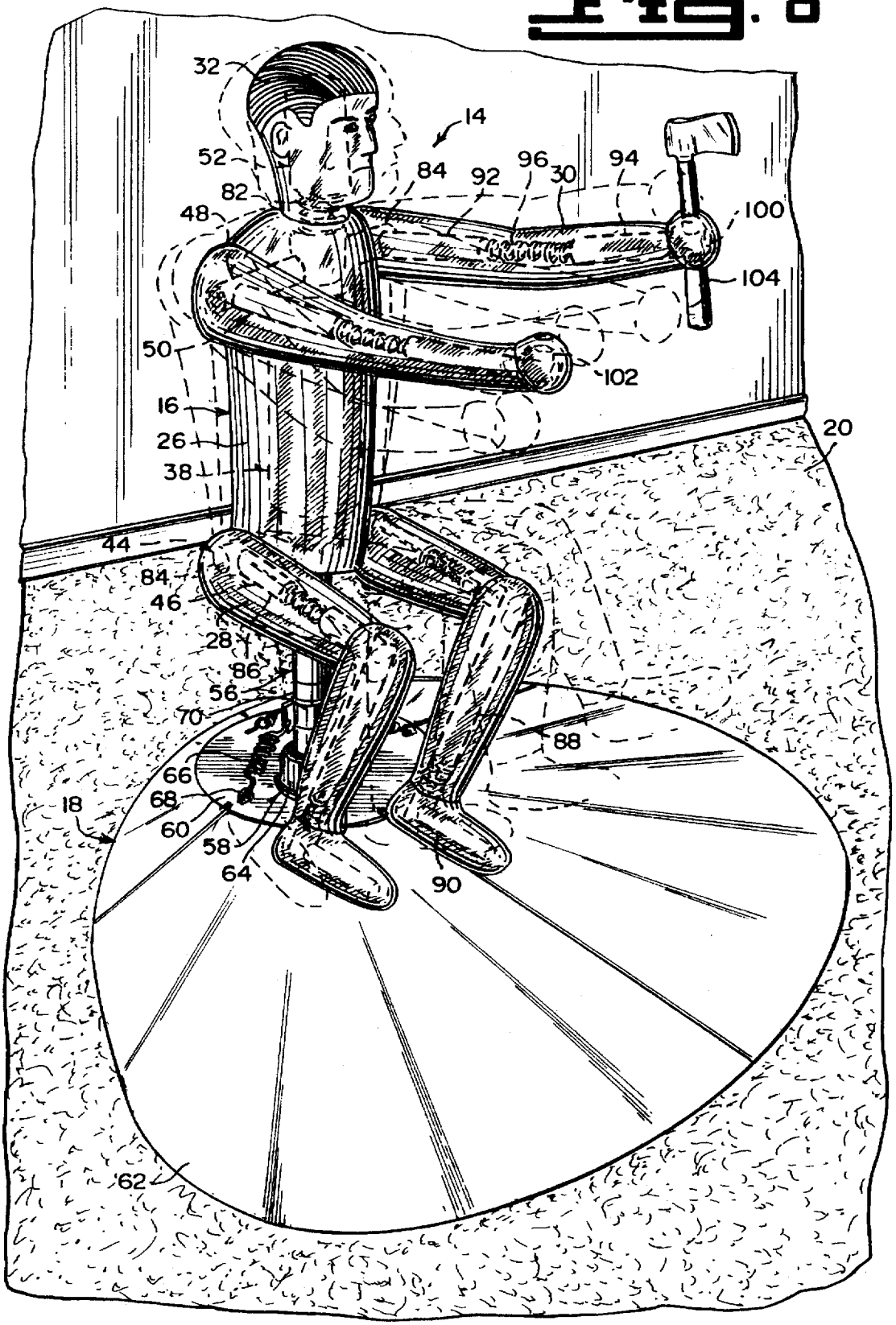
FIG. 8 is a perspective view of the instant invention, showing in dotted lines the internal skeletal framework within the mannequin and various movements of the mannequin.

Turning now descriptively to the drawings, in which similar reference characters denote similar elements throughout the several views, FIGS. 1 through 12 illustrate a martial arts training device 10, which comprises a movable mannequin 16 having a human appearance. A structure 18 is for supporting the mannequin 16 in a generally upright position from a floor 20. A facility 22 within the mannequin 16, as best seen in FIG. 12, is for showing a reaction movement of a portion of the mannequin 16 when another portion of the mannequin 16 receives a blow thereto from a martial artist 24.

The mannequin 16 contains a torso 26. A pair of articulated legs 28 are provided. Each leg 28 extends downwardly in a bent manner from the torso 26. A pair of articulated arms 30 are also provided. Each arm 30 extends forwardly from the torso 26. The mannequin 16 consists of a skeletal framework 34 and resilient padding 36 disposed over the skeletal framework 34.

The skeletal framework 34 includes a trunk member 38 carried in the torso 26 of the mannequin 16. The trunk member 38 has a pair of aligned lower cutouts 40 and a pair of aligned upper cutouts 42. A hip member 44 extends transversely through the lower cutouts 40 of the trunk member 38. A pair of leg members 46 are provided. Each leg member 46 extends downwardly in a bent manner from one end of the hip member 44 in the leg 28 of the mannequin 16.

A shoulder member 48 extends transversely through the upper cutouts 42 of the trunk member 38. A pair of arm members 50 are provided. Each arm member 50 extends forwardly from one end of the shoulder member 48 in the arm 30 of the mannequin 16. A skull member 52 extends upwardly from the trunk member 38 in the head 32 of the mannequin 16.

The supporting structure 18 contains a base 54 adapted to rest upon the floor 20. A stanchion 56 extends between the base 54 and a bottom end of the torso 26 of the mannequin 16, whereby the mannequin 16 can rotate about on the stanchion 56. An assemblage 58 is for rocking a bottom end of the stanchion 56 with the mannequin 16 back and forth upon the base 54 in any direction, when the mannequin 16 receives a blow from the martial artist 24. The base 54 includes a central hub 60 to maintain the rocking assemblage 58 thereon. A plurality of interlocking segments 62 extend about the hub 60 to stabilize the hub 60 upon the floor 20.

The rocking assemblage 58 consists of a universal swivel joint 64 mounted to the central hub 60 of the base 54. A plurality of tension springs 66 are provided. Each spring 66 is attached at a lower end to a lug 68 on the central hub 60 radially about the universal swivel joint 64. A spring tension adjustment member 70 is mounted to the stanchion 56 in an adjustable manner above the universal swivel joint 64. Each spring 66 is attached at an upper end to the spring tension adjustment member 70.

The reaction movement showing facility 22 contains a pair of pulleys 72. Each pulley 72 is mounted in a rotatable manner within the trunk member 38, one above the other between the lower cutouts 40 and the upper cutouts 42. A pair of cables 74 are provided. Each cable 74 crisscrosses the pair of pulleys 72 and attaches oppositely to the top of the hip member 44, adjacent one lower cutout 40 of the trunk member 38 and the bottom of the shoulder member 48 adjacent one upper cutout 42 of the trunk member 48. A first wire 76 is connected at opposite ends to the bottom of the hip member 44 adjacent the lower cutouts 46 of the trunk member 48.

A first heavy spring 78 is mounted at an upper end to the middle of the first wire 76 and at a lower end within the trunk member 38. A second wire 80 is connected at opposite ends to the top of the shoulder member 48 adjacent the upper cutouts 42 of the trunk member 38. A second heavy spring 82 is mounted at a lower end to the middle of the second wire 80 and at an upper end within the skull member 52 of the skeletal framework 34. The hip member 44 and the shoulder member 48 are elongated tubes 84, that can rock up and down within the trunk member 38.

Each of the leg members 46 are segmented having a thigh portion 86, a shank portion 88 jointed thereto and a foot portion 90 swiveled onto a lower end of the shank portion 88. Each of the arm members 50 are segmented having an upper arm portion 92, a forearm portion 94, a elbow spring 96 extending between the upper arm portion 92 and the forearm portion 94 with a central cable 98 extending therethrough and a hand portion 100 swiveled onto a lower end of the forearm portion 94. A socket portion 102 in the hand portion 100 holds a weapon 104 therein. A stopper 104, as shown in FIG. 11, can fit into the socket portion 102 when the weapon 104 is removed therefrom.

LIST OF REFERENCE NUMBERS 14 martial arts training device
16 movable mannequin of 14
18 supporting structure of 14 for 16
20 floor
22 reaction movement showing facility of 14 for 16
24 martial artist
26 torso of 16
28 articulated leg of 16
30 articulated arm of 16
32 head of 16
34 skeletal framework in 16
36 resilient padding on 34
38 trunk member of 34 in 26

40 lower cutout in 38
42 upper cutout in 38
44 hip member in 38
46 leg member of 34 on 44
48 shoulder member of 34 in 38
50 arm member of 34 on 48
52 skull member of 34 in 32
54 base of 18
56 stanchion of 18
58 rocking assemblage of 18
60 central hub of 54
62 interlocking segment of 54
64 universal swivel joint of 58
66 tension spring of 58
68 lug on 60
70 spring tension adjustment member of 58 on 56
72 pulley of 22
74 cable of 22
76 first wire of 22
78 first heavy spring of 22
80 second wire of 22
82 second heavy spring of 22
84 elongated tube for 44 and 48
86 thigh portion of 46
88 shank portion of 46
90 foot portion of 46
92 upper arm portion of 50
94 forearm portion of 50
96 elbow spring between 92 and 94
98 central cable of 50
100 hand portion on 94
102 socket portion in 100
104 stopper in 100

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A martial arts training device which comprises:

a) a movable mannequin having a human appearance;

b) means for supporting said mannequin in a generally upright position from a floor, said supporting means including:

i) a base adapted to rest upon the floor;

ii) a stanchion extending between said base and a bottom end of a torso of said mannequin, whereby said mannequin can rotate about on said stanchion; and iii) means for rocking a bottom end of said stanchion with said mannequin back and forth upon Said base in any direction, when said mannequin receives a blow from the martial artist; and c) means within said mannequin, for showing a reaction movement of a portion of said mannequin, when another portion of said mannequin receives a blow thereto from a martial artist.

2. A martial arts training device as recited in claim 1, wherein said mannequin includes:

a) a torso;

b) a pair of articulated legs, each said leg extending downwardly in a bent manner from said torso;

c) a pair of articulated arms, each said arm extending forwardly from said torso; and d) a head extending upwardly from said torso.

3. A martial arts training device as recited in claim 1, wherein said mannequin includes:

a) a skeletal framework; and b) resilient padding disposed over said skeletal framework.

4. A martial arts training device which comprises:

a) a movable mannequin having a human appearance, including a skeletal framework and resilient padding disposed over said skeletal framework, said skeletal framework having:

i) a trunk member carried in a torso of said mannequin, said trunk member having a pair of aligned lower cutouts and a pair of aligned upper cutouts;

ii) a hip member extending transversely through said lower cutouts of said trunk member;

iii) a pair of leg members, in which each said leg member extends downwardly in a bent manner from one end of said hip member in a leg of said mannequin;

iv) a shoulder member extending transversely through said upper cutouts of said trunk member;

v) a pair of arm members, in which each said arm member extends forwardly from one end of said shoulder member in an arm of said mannequin; and vi) a skull member extending upwardly from said trunk member in a head of said mannequin;

b) means for supporting said mannequin in a generally upright position from a floor; and c) means within said mannequin, for showing a reaction movement of a portion of said mannequin, when another portion of said mannequin receives a blow thereto from a martial artist.

5. A martial arts training device as recited in claim 1, wherein said base includes:

a) a central hub to maintain said rocking means thereon; and b) a plurality of interlocking segments extending about said hub to stabilize said hub upon the floor.

6. A martial arts training device as recited in claim 5, wherein said rocking means includes:

a) a universal swivel joint mounted to said central hub of said base;

b) a plurality of tension springs, in which each said spring is attached at a lower end to a lug on said central hub radially about said universal swivel joint; and c) a spring tension adjustment member mounted to said stanchion in an adjustable manner above said universal swivel joint, whereby each said spring is attached at an upper end to said spring tension adjustment member.

7. A martial arts training device as recited in claim 4, wherein said reaction movement showing means includes:

a) a pair of pulleys, in which each said pulley is mounted in a rotatable manner within said trunk member one above the other between said lower cutouts and said upper cutouts;

b) a pair of cables, in which each said cable crisscrosses said pair of pulleys and attaches oppositely to the top of said hip member adjacent one said lower cutout of said trunk member and the bottom of said shoulder member adjacent one said upper cutout of said trunk member;

c) a first wire connected at opposite ends to the bottom of said hip member adjacent said lower cutouts of said trunk member;

d) a first heavy spring mounted at an upper end to the middle of said first wire and at a lower end within said trunk member;

e) a second wire connected at opposite ends to the top of said shoulder member adjacent said upper cutouts of said trunk member; and f) a second heavy spring mounted at a lower end to the middle of said second wire and at an upper end within said skull member of said skeletal framework.

8. A martial arts training device as recited in claim 4, wherein said hip member and said shoulder member are elongated tubes that can rock up and down within said trunk member.

9. A martial arts training device as recited in claim 4, further including:

a) each of said leg members are segmented having a thigh portion, a shank portion jointed thereto and a foot portion swiveled onto a lower end of said shank portion;

b) each of said arm members are segmented having an upper arm portion, a forearm portion, an elbow spring extending between said upper arm portion and said forearm portion with a central cable extending therethrough and a hand portion swiveled onto a lower end of said forearm portion;

c) a socket portion in said hand portion to hold a weapon therein; and d) a stopper to fit into said socket portion when the weapon is removed therefrom.

10. A martial arts training device which comprises:

a) a movable mannequin having a torso, a pair of articulated legs extending downwardly in a bent manner from said torso, a pair of articulated arms extending forwardly from said torso and a head extending upwardly from said torso, including a skeletal framework and resilient padding disposed over said skeletal framework, said skeletal framework having:

i) a trunk member carried in a torso of said mannequin, said trunk member having a pair of aligned lower cutouts and a pair of aligned upper cutouts;

ii) a hip member extending transversely through said lower cutouts of said trunk member;

iii) a pair of leg members, in which each said leg member extends downwardly in a bent manner from one end of said hip member in a leg of said mannequin;

iv) a shoulder member extending transversely through said upper cutouts of said trunk member;

v) a pair of arm members, in which each said arm member extends forwardly from one end of said shoulder member in an arm of said mannequin; and vi) a skull member extending upwardly from said trunk member in a head of said mannequin;

b) means for supporting said mannequin in a generally upright position from a floor; and c) means within said mannequin, for showing a reaction movement of a portion of said mannequin, when another portion of said mannequin receives a blow thereto from a martial artist.

11. A martial arts training device as recited in claim 10, wherein said supporting means includes:

a) a base adapted to rest upon the floor;

b) a stanchion extending between said base and a bottom end of said torso of said mannequin, whereby said mannequin can rotate about on said stanchion; and c) means for rocking a bottom end of said stanchion with said mannequin back and forth upon said base in any direction, when said mannequin receives a blow from the martial artist.

12. A martial arts training device as recited in claim 11, wherein said base includes:

a) a central hub to maintain said rocking means thereon; and b) a plurality of interlocking segments extending about said hub to stabilize said hub upon the floor.

13. A martial arts training device as recited in claim 12, wherein said rocking means includes:

a) a universal swivel joint mounted to said central hub of said base;

b) a plurality of tension springs, in which each said spring is attached at a lower end to a lug on said central hub radially about said universal swivel joint; and c) a spring tension adjustment member mounted to said stanchion in an adjustable manner above said universal swivel joint, whereby each said spring is attached at an upper end to said spring tension adjustment member.

14. A martial arts training device as recited in claim 13, wherein said reaction movement showing means includes:

a) a pair of pulleys, in which each said pulley is mounted in a rotatable manner within said trunk member one above the other between said lower cutouts and said upper cutouts;

b) a pair of cables, in which each said cable crisscrosses said pair of pulleys and attaches oppositely to the top of said hip member adjacent one said lower cutout of said trunk member and the bottom of said shoulder member adjacent one said upper cutout of said trunk member;

c) a first wire connected at opposite ends to the bottom of said hip member adjacent said lower cutouts of said trunk member;

d) a first heavy spring mounted at an upper end to the middle of said first wire and at a lower end within said trunk member;

e) a second wire connected at opposite ends to the top of said shoulder member adjacent said upper cutouts of said trunk member; and f) a second heavy spring mounted at a lower end to the middle of said second wire and at an upper end within said skull member of said skeletal framework.

15. A martial arts training device as recited in claim 14, wherein said hip member and said shoulder member are elongated tubes that can rock up and down within said trunk member.

16. A martial arts training device as recited in claim 15, further including:

a) each of said leg members are segmented having a thigh portion, a shank portion jointed thereto and a foot portion swiveled onto a lower end of said shank portion;

b) each of said arm members are segmented having an upper arm portion, a forearm portion, an elbow spring extending between said upper arm portion and said forearm portion with a central cable extending therethrough and a hand portion swiveled onto a lower end of said forearm portion;

c) a socket portion in said hand portion to hold a weapon therein; and d) a stopper to fit into said socket portion when the weapon is removed therefrom.

* * * * *